US005769040A

United States Patent [19]

Christner et al.

[11] Patent Number: 5,769,040

[45] Date of Patent: Jun. 23, 1998

[54] TWO CYCLE INTERNAL COMBUSTION ENGINE

[76] Inventors: Oval F. Christner, 3596 Prudence Dr., Sarasota, Fla. 34235; David L. Christner, 4626 Country Manor Dr., Sarasota, Fla. 34233

[21] Appl. No.: 844,072

[22] Filed: Apr. 18, 1997

[51] Int. Cl.[6] ..... F02B 25/08

[52] U.S. Cl. ..... 123/65 V; 123/65 S

[58] Field of Search ..... 123/65 V, 65 VA, 123/65 VS, 65 S

[56] References Cited

U.S. PATENT DOCUMENTS

| | | | |
|---|---|---|---|
| 2,274,197 | 2/1942 | Godfrey | 123/65 VA |
| 3,000,366 | 9/1961 | Blackburn | 123/65 VA |
| 3,395,679 | 8/1968 | Christner . | |
| 3,736,911 | 6/1973 | Melchlor | 123/65 VA |
| 3,815,558 | 6/1974 | Tenney . | |
| 3,948,241 | 4/1976 | Melchior | 123/65 VA |
| 4,068,629 | 1/1978 | Hooper . | |
| 4,864,980 | 9/1989 | Riese . | |
| 5,040,496 | 8/1991 | Plohberger et al. . | |
| 5,143,029 | 9/1992 | Christenson | 123/65 VA |
| 5,159,903 | 11/1992 | Takahashi . | |
| 5,189,995 | 3/1993 | Hooper | 123/65 S |
| 5,477,838 | 12/1995 | Schlunke et al. . | |
| 5,490,483 | 2/1996 | Tanikaka et al. . | |
| 5,540,195 | 7/1996 | Vegh . | |
| 5,586,525 | 12/1996 | Masse | 123/65 V |
| 5,638,780 | 6/1997 | Duvinage et al. | 123/65 VA |

OTHER PUBLICATIONS

Car & Design & Technology "One Step beyond" Article on Bernard Hooper; Jan., 1995.

RPVs Ninth International Conference—Design & Development of the 30kW RPV Stepped Piston Engine Sep. 1991.

*Primary Examiner*—David A. Okonsky

*Attorney, Agent, or Firm*—Charles J. Prescott

[57] ABSTRACT

An improved two cycle internal combustion engine, preferably of a stepped piston type, having a unique arcuately shaped transfer deflector valve, which varies by its controlled sliding movement within an inlet passage, the size of exposed opening of an elongated inlet port in the cylinder. The inlet port extends circumferentially part way around the cylinder. The leading end of the valve is preferably angled, in cooperation with the preferably almost tangent orientation of the inlet passage, to induce arcuate movement into each fresh full charge entering the combustion chamber for enhanced fuel charge mixing. In the preferred embodiment, two such valves are symmetrically positioned around the cylinder and arcuately move in unison between closed and open positions over corresponding opposing inlet ports.

15 Claims, 4 Drawing Sheets

TWO CYCLE INTERNAL COMBUSTION ENGINE

BACKGROUND OF THE INVENTION

1. Scope of Invention

This application relates generally to two stroke internal combustion engines, and more particularly to an improved inlet valve for improved modulation of fuel charge in response to engine operating conditions.

2. Prior Art

Two cycle or two stroke engines are well known for both simplicity and high power output. However, relatively poor economy and inefficient and unstable low r.p.m. operating conditions as a result of poor scavenging of exhaust gases from the chamber during each cycle have detracted from the overall simplicity and performance virtues of the two cycle engine. A further limitation of the two cycle engine design is a typical inefficient direction capability of each fresh fuel charge flowing into the combustion chamber through inlet ports which are normally sized for much higher fuel charge flow for near or peak performance operation.

Two variants of two cycle engines have developed to improve this low r.p.m., low power scavenging. One improvement depends upon crankcase compression for charging the cylinders, while the other improvement depends upon a separate engine driven air pump or compressor. Crankcase compression requires a sealed crankcase for each cylinder containing a very minimum amount of free lubricating oil to minimize combustion smoke in the form of excess hydrocarbon emissions. A separate air compressor removes the need for a sealed crankcase, but is expensive, bulky and relatively inefficient and difficult to match the engine's demand through the entire load and speed range.

Bernard Hooper, over decades of development, has improved upon the stepped piston design concept for two cycle internal combustion engines which combines a cylinder having a smaller diameter for combustion and a larger diameter for scavenging exhaust gases and delivering a fresh charge of fuel during each piston cycle. In its preferred form, two adjacent cylinders oriented for alternate firing are utilized to cross feed one another from their respective larger pumping sections.

At least one variant of the stepped piston concept which utilizes only a single cylinder is disclosed in U.S. Pat. No. 5,540,195 invented by Vegh. Entitled a "Vuka Two Stroke Engine", Vegh discloses an improved two stroke internal combustion engine utilizing a vacuum chamber to create a vacuum which sucks the exhaust out of the combustion chamber and forces each new charge into it.

Tenney, in U.S. Pat. No. 3,815,558, teaches a scavenge porting system for a two cycle engine which utilizes the underneath side of the piston as a scavenge pump piston. Tenney teaches the improvements of extra height, piston valved scavenge ports which are additionally valved by reed valves located in the transfer passageway close to the scavenging ports.

Bernard Hooper, in 1978, also received U.S. Pat. No. 4,068,629 which teaches the utilization of both main and auxiliary inlet ports for improved fuel charge stratification. Air only is supplied into each combustion chamber through the main inlet port, while fuel is injected into the air passage through the auxiliary transfer passages so that a mixture of fuel and air enters the combustion chamber through the auxiliary ports. However, this invention otherwise has very little control over the size of the transfer ports themselves.

In U.S. Pat. No. 4,864,980, Riese has invented an exhaust valve throttling mechanism for two stroke engines. However, as this invention is directed to throttling mechanism of the rotary valve type directed only to exhaust ports, its usefulness and pertinence to the present invention is minimal.

A supercharged engine is disclosed in U.S. Pat. No. 5,477,838 invented by Schlunke, et al. having a multicylinder two stroke engine which claims to achieve optimal combustion conditions for varied engine load and speed conditions. The supercharger, being coupled to the engine crank shaft and interposed between the cylinder block and the engine flywheel, adds considerable complexity and cost to this design, however.

Plohberger, et al., in U.S. Pat. No. 5,040,496, teaches flow guide veins to straighten each fresh fuel charge so as to insure proper flow direction as it enters the combustion chamber. In U.S. Pat. No. 5,159,903, Takashi has disclosed an air intake system for multicylinder two cycle engines which includes scavenge manifolds that extend around the cylinder bores in communication with circumferentially spaced scavenge ports to insure that each fresh fuel charge is not directed toward the exhaust ports.

Thus, there is no invention disclosed to date in prior art known to applicant which teaches an effective means for varying the size of the inlet port in relation to selected variables of engine speed and power requirements and to provide a desired direction and rotational momentum to each fresh fuel charge as it enters the combustion chamber so as to maximize efficiency and fuel mixtures as all speeds, especially low speed and low power operating conditions for improved smoothness and efficiency.

BRIEF SUMMARY OF THE INVENTION

This invention is directed to an improved two cycle internal combustion engine, preferably of a stepped piston type, having a unique arcuately shaped transfer deflector valve, which varies by its controlled sliding arcuate movement within an inlet passage, the size of exposed opening of an elongated inlet port in the cylinder, the inlet port extending circumferentially part way around the cylinder. The leading end of the valve is preferably angled and, in cooperation with the preferably almost tangent orientation of the inlet passage, induces arcuate movement into each fresh full charge entering the combustion chamber for enhanced fuel charge mixing. In the preferred embodiment, two such valves are symmetrically positioned in the cylinder and move in unison between closed and open positions over corresponding opposing inlet ports.

It is therefore an object of this invention to provide an improved inlet port and inlet valve arrangement which varies the valve inlet port size in relation to engine r.p.m. and power requirements.

It is still another object of this invention to provide an improved inlet port and valving arrangement for two cycle engines which improves the overall efficiency, stability and smoothness of two cycle engine operation, especially at lower speeds and power settings.

It is yet another object of this invention to provide an improved inlet port and inlet valve arrangement for stepped piston two cycle engines with improved overall efficiency, especially at lower engine r.p.m. and power levels.

It is still another object of this invention to provide a multiple cylinder alternate firing two cycle engine with improved inlet valve sizing and control for improved overall engine performance and economy, especially at lower engine r.p.m.

It is yet another object of this invention to utilize the pumping action of all stepped pistons fed into a common carrier or manifold to be fed into each inlet port of each combustion chamber.

It is another object of this invention, in a two cycle engine, to increase fuel charge velocity and direction entering the cylinder and directed away from the exhaust port even at lower engine r.p.m. and power settings for enhanced lower speed performance and uniformity by minimizing the mixture of fuel charge and exhaust gasses.

In accordance with these and other objects which will become apparent hereinafter, the instant invention will now be described with reference to the accompanying drawings.

DETAILED DESCRIPTION OF THE INVENTION

Figure 1:
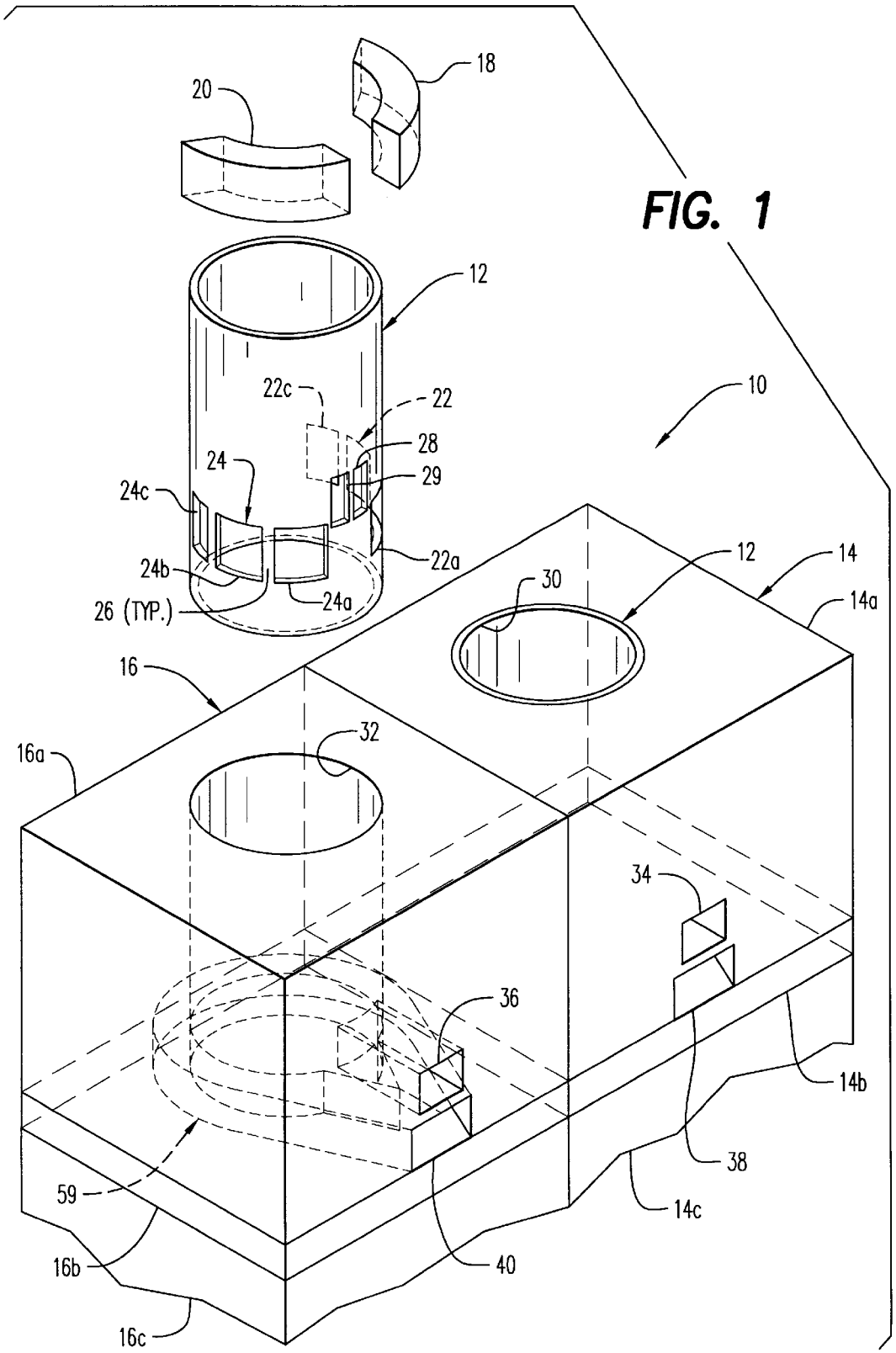
FIG. 1 is an exploded perspective view of a two-cycle, stepped piston, twin cylinder preferred embodiment of the invention.
Figure 2:
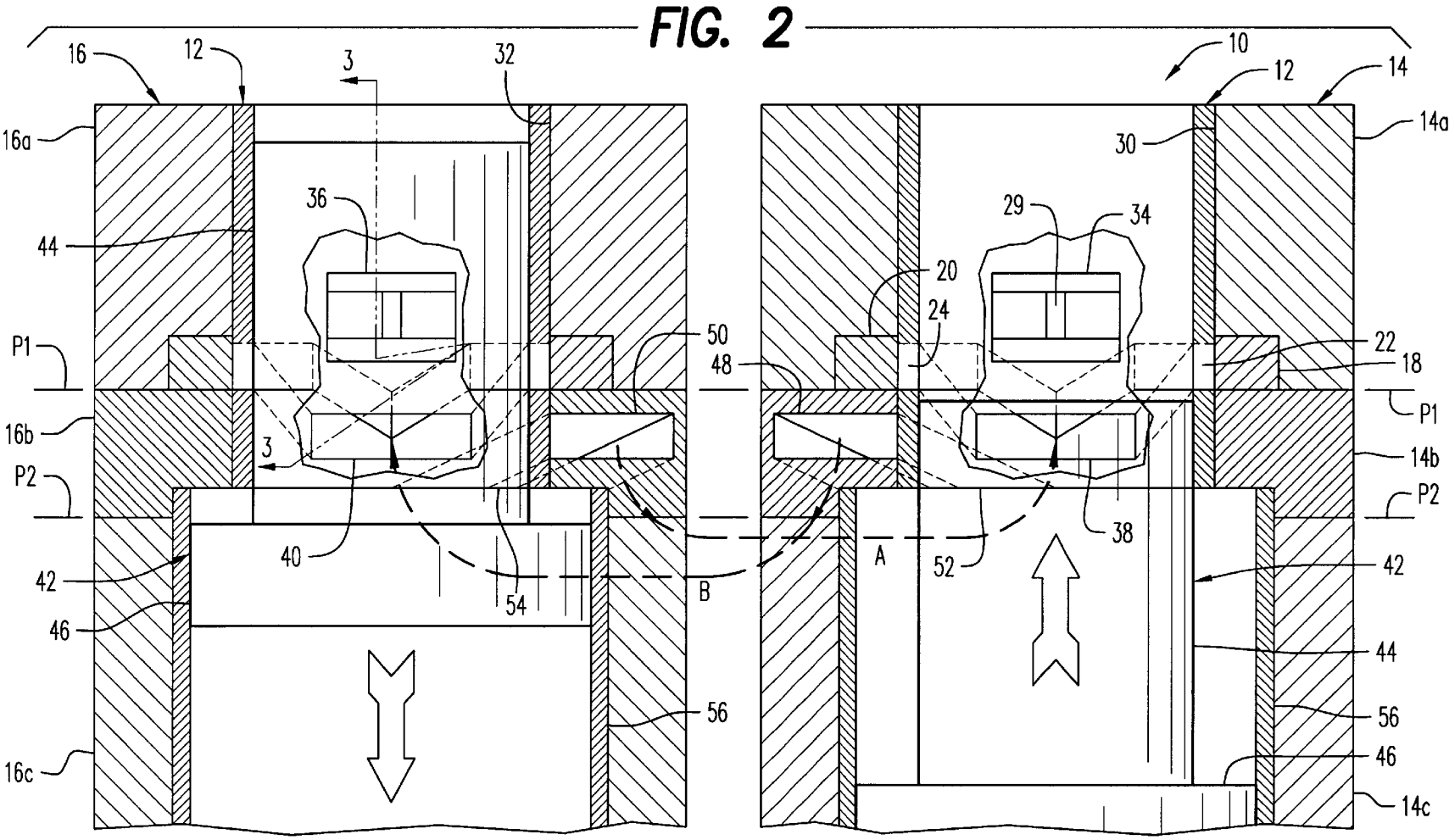
FIG. 2 is a broken vertical section view in the plane of each piston axis of FIG. 1 with cylinder blocks 14 and 16 spaced apart for clarity.
Figure 5:
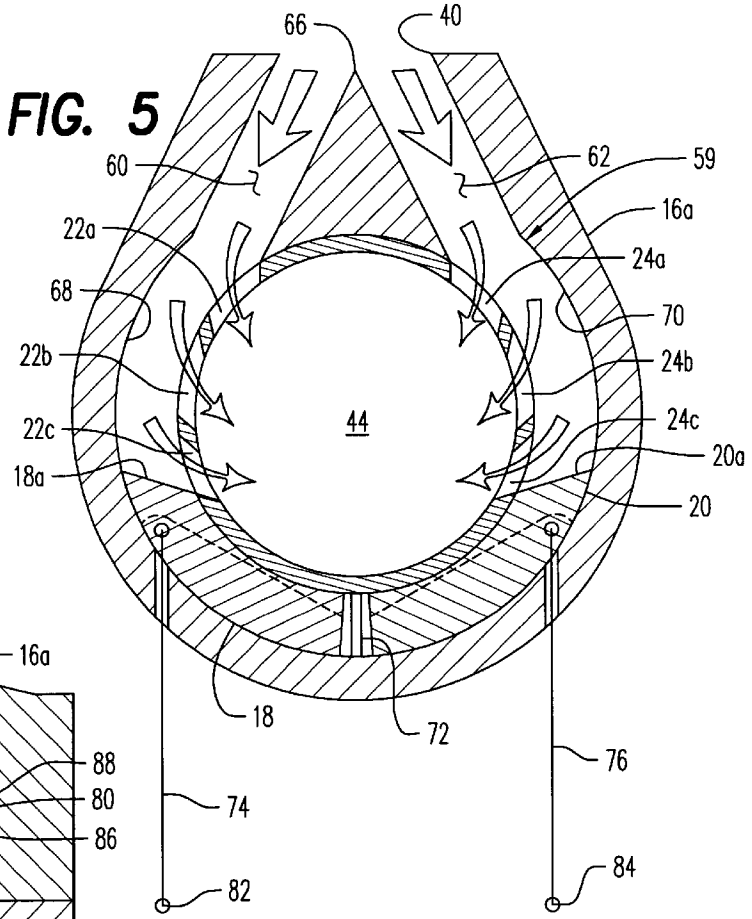
FIG. 5 is a view similar to FIG. 4 with the transfer deflector valves in a wide open throttle position.
Figure 4:
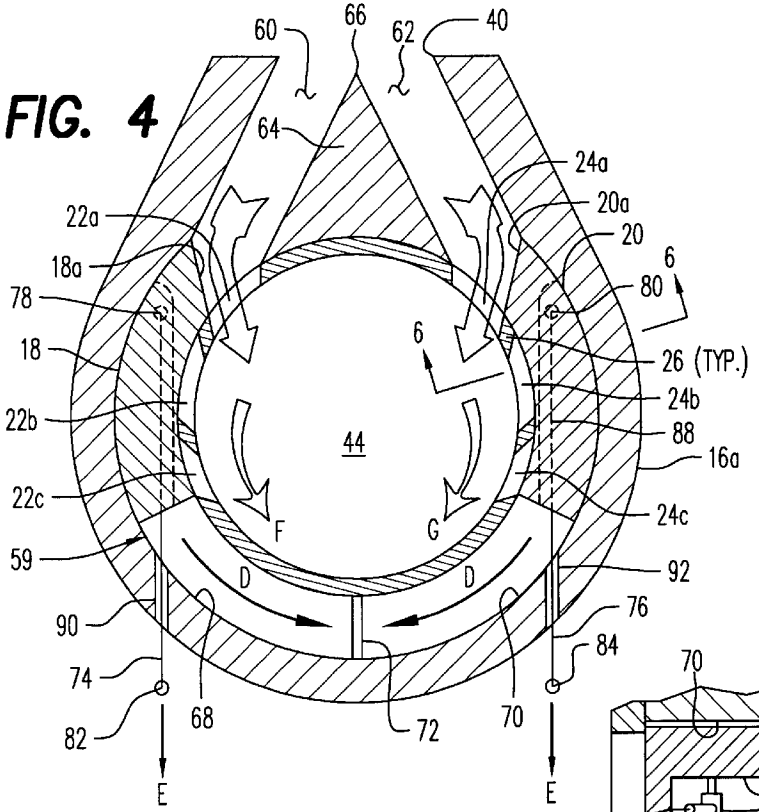
FIG. 4 is a horizontal section view passing through the inlet passages and inlet ports of FIG. 2 with the transfer deflector valves in a closed position.

Referring now to the drawings, the preferred embodiment of the invention is shown generally at numeral 10 and includes a pair of cylinder liners 12 which mateably engage into cylinder bores 30 and 32 of cylinder blocks 14 and 16, respectively as best seen in FIGS. 1 and 2. Each cylinder liner 12 is sized to mateably engage around the combustion section or smaller diameter 44 of a stepped piston 42 as best seen in FIG. 2. The volume defined between the head or top of each piston 42 and the cylinder liner 12 is called a combustion chamber Each cylinder liner 12 includes a set of opposing symmetrically positioned inlet ports 22 and 24 which extend circumferentially part way around the cylinder wall 12 as best seen in FIGS. 1, 4 and 5. Each of these inlet ports 22 and 24 comprise a series of inlet port segments 22*a, b, c* and 24*a, b, c*, respectively. Each of the individual inlet port segments are separated by a thin upright cylinder wall segment shown typically at 26 so as to prevent hang-ups of the combustion piston section sealing rings (not shown).

The cylinder wall 12 also includes an exhaust port 28 which is spaced evenly between and slightly above each of the inlet ports 22 and 24 and also includes a thin upright segment 29 to prevent piston ring hang-up.

Figure 3:
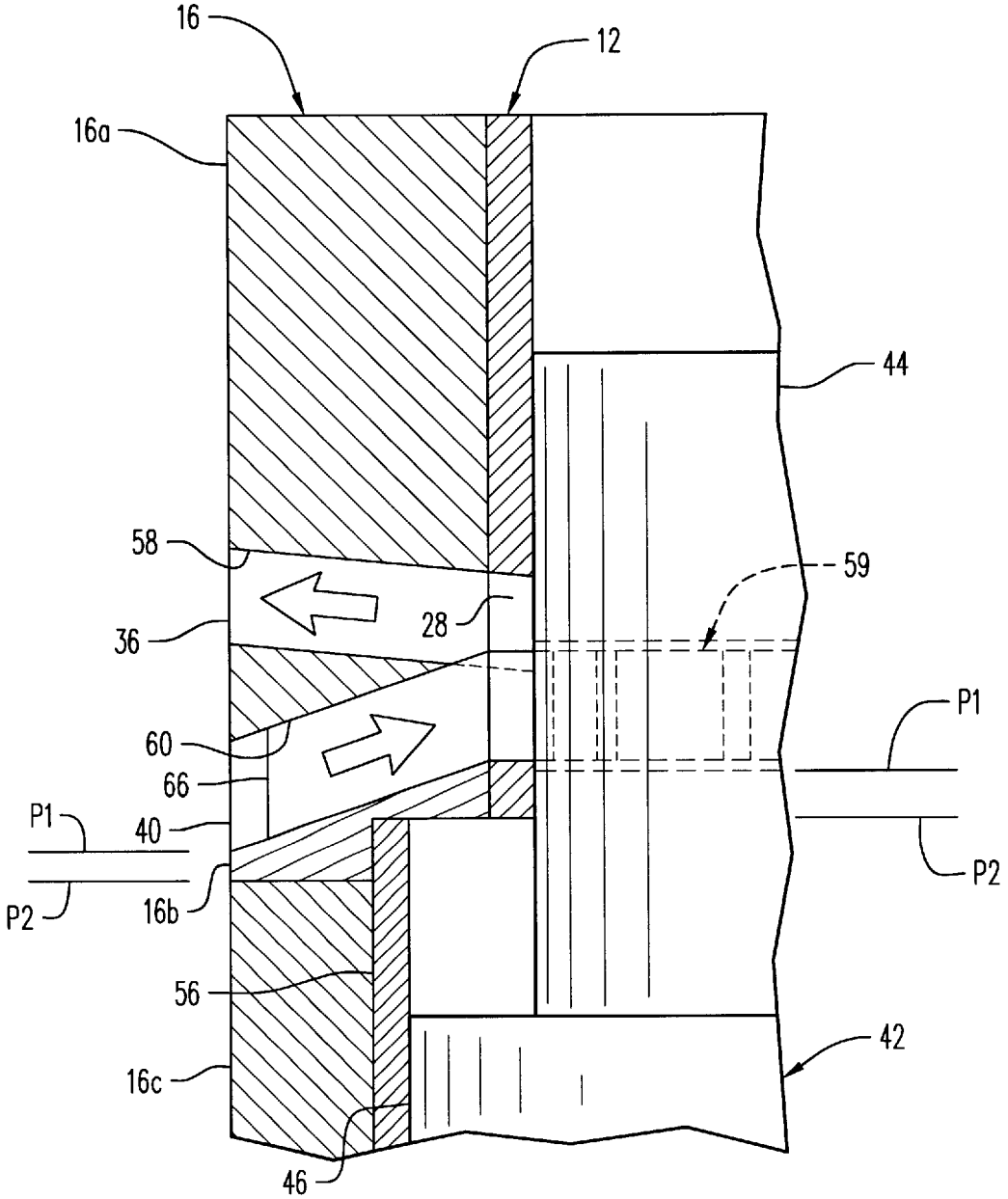
FIG. 3 is a section view in the direction of arrows 3—3 in FIG. 2.

In the preferred stepped piston embodiment best seen in FIGS. 2 and 3, each piston 42 includes the combustion section 44 which is smaller in diameter and sealably engaged within the cylinder wall 12 and also includes a lower pumping section 46 of larger diameter which slidably translates in sealed fashion within pumping section cylinder liners 56.

Each of these cylinder blocks 14 and 16 (shown in detail only for cylinder block 16) are comprised of cylinder block sections 14*a, b, c* and 16*a, b, c*, respectively, which are parted at P1 and P2, respectively. Each cylinder block 14 and 16 includes a somewhat annular shaped inlet passage shown generally at 59 which extends from inlet 40 in cylinder block 16 and inlet 38 in cylinder block 14. As best seen in FIGS. 1, 4 and 5, the inlet passage 59 extends from the inlet 40 and is diverted by separator 66 into inlet passage portions 60 and 62 which are oriented generally tangentially to the cylinder liner 12 and generally aligned with inlet ports 22 and 24.

Disposed within the inlet passageway 59 are two opposing transfer deflector valves 18 and 20. These valves 18 and 20 are slidably positioned within inlet passageway portions 68 and 70 as best seen in FIGS. 4 and 5. Each of the valves 18 and 20 are arcuately configured having inner cylindrical surfaces which sealably mate against the outer surface of the cylinder wall 12. Each valve 18 and 20 has an elongated length which, as best seen in FIG. 4 in a low speed or idle position, preferably covers two of the three inlet port segments 22*b, c* and 24*b, c*. In this configuration, a smaller fuel charge may enter the combustion chamber through inlet portions 22*a* and 24*a* in the direction of the arrows only.

Note that the leading ends 18*a* and 20*a* of each valve 18 and 20 are angled so that, in cooperation with the generally tangent orientation of inlet passage portions 60 and 62, and, further, in alignment with the angled first upright segment 26 (type.), acting as a directional vane, the inlet gasses enter the combustion chamber having an arcuate component shown by the arrows which enhances each fuel charge mixture blend. Further, each fuel charge is directed to the far side of the cylinder as shown by arrows F and G in FIG. 4 away from the exhaust port to enhance separation between fresh fuel charges and exhaust gasses. Moreover, the valves 18 and 20 could be elongated to cover a portion or even all of these first inlet port segments 22*a* and 24*a*.

As seen in FIG. 5, the valves 18 and 20 are shown in their wide open throttle position where the trailing ends abut stop 72 so that all of the inlet ports 22*a, b, c* and 24*a, b, c* are open and in full fluid communication between the air passageway 59 and the corresponding combustion chamber. In this configuration, air/fuel charges which enter passageway portions 60 and 62 in the direction of the arrows in FIGS. 3 to 5 also achieve a rotational or swirling component enhanced by angled leading surfaces 18*a* and 20*a* as shown by those arrows in FIGS. 4 and 5. Thus, as each fuel charge enters the combustion chamber through the inlet ports as shown by the arrows, the angular or rotational component results in enhanced mixing and swirling of each fresh fuel charge.

Figure 6:
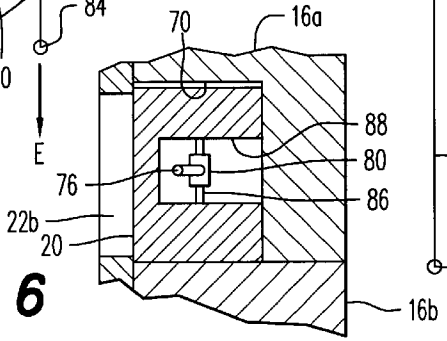
FIG. 6 is a section view in the direction of arrows 6—6 in FIG. 4.

Referring to FIGS. 4, 5 and 6, to facilitate the selective positioning of the valves 18 and 20, linkages 74 and 76, which are pivotally connected to each corresponding valve 18 and 20 at 78 and 80 on pins 86, are controlledly moved in the direction of arrows E in FIG. 4 so as to move each of the valves 18 and 20 from their closed position shown. The exposed ends 82 and 84 of these linkages 74 and 76 are connected to a suitable control means (not shown) which may operate in response to any of the engine operating variables desired, such as throttle setting, engine speed, engine load, etc. The linkages 74 and 76 extend from the cylinder block 16 (not shown with respect to cylinder block 14) through sealed apertures 90 and 92 and nest within elongated clearance cavities shown typically at 88 in FIG. 6 formed into the back side of each valve 18 and 20.

It should be understood that, in the broadest sense, the unique valve arrangement which provides for the selective opening of only a desired portion of the corresponding inlet port of a two cycle engine may be singular in nature. That is to say that this invention may be practiced utilizing only a single transfer deflector valve 18 or 20 in conjunction with only a single inlet port 22 or 24. However, in the preferred embodiment, opposing symmetrically positioned inlet ports 22 and 24 and valves 18 and 20 are preferred as above described. Likewise, these valves may be fabricated of thin flexible spring steel operating in an arcuate channel and be within the scope of this invention, with the possible loss of only the outlet leading end fuel flow redirectional features.

Moreover, this valve arrangement whether in singular or in multiple forms, may also be utilized in conjunction with either single diameter or preferably stepped diameter cylinders and pistons. Referring to FIG. 2, the pumping action of the stepped piston arrangement is there depicted wherein as the pumping section 46 of piston 42 in cylinder block 16 moves downwardly to draw a new fuel charge into the pumping section of cylinder 56 (not shown), the piston 42 in cylinder block 14 moving upwardly to force a new fuel charge from passageway 48 in the direction of arrow B into inlet 40. Then, reversing the sequencing of piston movement, a fresh fuel charge, whether mixed with air or by timed fuel injection, is forced from passageway 50 in cylinder block 16 into inlet 38 of cylinder block 14.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An inlet system for a two cycle internal combustion engine comprising:

a cylinder and a piston which slidably translates within said cylinder and defining a combustion chamber between a closed end of said cylinder and a head of said piston;

a wall of said cylinder including at least two inlet ports therethrough extending substantially circumferentially part way around said cylinder and in fluid communication with an inlet passage;

an elongated arcuately shaped transfer deflector valve mounted for sliding arcuate movement within said inlet passage which, when closed, is in substantial alignment with at least one said inlet port, an inner arcuate surface of said transfer deflector valve substantially sealingly engaged against a portion of an outer surface of said cylinder wall adjacent at least one said inlet port;

said transfer deflector valve sized and slidably movable between a closed position wherein at least a substantial portion of at least one of said inlet port is covered by said transfer deflector valve and an open position wherein substantially all of at least one said inlet port is open and uncovered by said transfer deflector valve;

means for controlledly positioning said transfer deflector valve at any point between said closed and said open position whereby said inlet ports are sequentially opened in proportion to movement of said transfer deflector valve.

2. An inlet system for a two cycle stepped piston internal combustion engine comprising:

first and second cylinders positioned in spaced side by side relation and adapted for alternate firing, said first and second cylinders each having a smaller diameter combustion section and a larger diameter pumping section;

a stepped piston for each said cylinder including a power section in substantially sealed sliding contact within said combustion section of said cylinder and a pumping section in substantially sealed sliding contact within said pumping section of said cylinder;

a wall of each said combustion section of each said cylinder including at least two inlet ports therethrough extending circumferentially part way therearound in fluid communication with an inlet passage;

an elongated arcuately shaped transfer deflector valve mounted for sliding arcuate movement within each said inlet passage in substantial alignment with at least one corresponding said inlet port, an inner arcuate surface of each said transfer deflector valve substantially sealingly engaged against a portion of an outer surface of said cylinder wall adjacent at least one said inlet port;

each said transfer deflector valve sized and slidably moveable between a closed position wherein at least a substantial portion of at least one corresponding said inlet port is covered by one said transfer deflector valve and an open position wherein substantially all of each said inlet port is open and uncovered by said transfer deflector valve;

means for controlledly positioning each said transfer deflector valve anywhere between said closed and said open position;

two transfer passages each in fluid communication between said pumping section of said cylinder and a corresponding said inlet passage of said cylinder whereby a fresh fuel charge drawn into each said pumping section during each downstroke of a corresponding said piston and is forced into said inlet passage of said cylinder during each upstroke of the corresponding said piston.

3. An inlet system for a two cycle internal combustion engine as set forth in claim 1, wherein:

a leading end of said transfer deflector valve is angled in cooperation with said inlet passage whereby each fresh fuel charge entering said inlet passage is deflected into said combustion chamber having an arcuate movement for enhanced fuel mixture uniformity just prior to combustion.

4. An inlet system for a two cycle internal combustion engine as set forth in claim 1, further comprising:

a second transfer deflector valve having a substantially mirror image shape of said transfer deflector valve and symmetrically positioned in opposing fashion with respect to said transfer deflector valve for sliding arcuate movement within a portion of a second inlet passage which is in substantial alignment and fluid communication with a second elongated inlet port formed through said wall of said cylinder;

said second inlet port being symmetric in size and positioning with respect to said inlet port, said second transfer deflector valve being slidably moveable between said closed and said open position with respect to said second inlet port;

means for controlledly positioning said second transfer deflector valve at any point between said open and said closed position simultaneously with that of said transfer deflector valve.

5. An inlet system for a two cycle internal combustion engine comprising:

a cylinder and a piston which slidably translates within said cylinder and defining a combustion chamber between a closed end of said cylinder and a head of said piston;

a wall of said cylinder having at least two inlet ports therethrough extending substantially circumferentially part way around said cylinder through less than about 180° and in fluid communication with an inlet passage;

an elongated arcuately shaped valve means for sliding arcuate movement within said inlet passage which en closed is in substantial alignment with at least one said inlet port, an inner arcuate surface of said valve means being substantially sealingly engaged against a portion of an outer surface of said cylinder wall adjacent at least one said inlet port;

means for controlledly positioning said valve means at any point between a closed position wherein at least a substantial portion of at least one said inlet port is covered by said valve means and said open position wherein substantially all of at least one said inlet port is open and uncovered by said valve means.

6. An inlet system for a two cycle internal combustion engine as set forth in claim 2, wherein:

a leading end of each said transfer deflector valve is angled in cooperation with each said inlet passage whereby each fresh fuel charge entering each said inlet passage is deflected into said combustion chamber having an arcuate movement for enhanced fuel mixture uniformity just prior to combustion.

7. An inlet system for a two cycle internal combustion engine as set forth in claim 2, further comprising:

a second transfer deflector valve having a substantially mirror image shape of said transfer deflector valve and symmetrically positioned in opposing fashion with respect to said transfer deflector valve for sliding arcuate movement within a portion of a second inlet passage which is in substantial alignment and fluid communication with a second elongated inlet port formed through said wall of said cylinder;

said second inlet port being symmetric in size and positioning with respect to said inlet port, said second transfer deflector valve being slidably moveable between said closed and said open position with respect to said second inlet port;

means for controlledly positioning said second transfer deflector valve at any point between said open and said closed position simultaneously with that of said transfer deflector valve.

8. An inlet system for a two cycle internal combustion engine as set forth in claim 5, wherein:

a leading end of said transfer deflector valve is angled in cooperation with said inlet passage whereby each fresh fuel charge entering said inlet passage is deflected into said combustion chamber having an arcuate movement for enhanced fuel mixture uniformity just prior to combustion.

9. An inlet system for a two cycle internal combustion engine as set forth in claim 5, further comprising:

a second transfer deflector valve having a substantially mirror image shape of said transfer deflector valve and symmetrically positioned in opposing fashion with respect to said transfer deflector valve for sliding arcuate movement within a portion of a second inlet passage which is in substantial alignment and fluid communication with a second elongated inlet port formed through said wall of said cylinder;

said second inlet port being symmetric in size and positioning with respect to said inlet port, said second transfer deflector valve being slidably moveable between said closed and said open position with respect to said second inlet port;

means for controlledly positioning said second transfer deflector valve at any point between said open and said closed position simultaneously with that of said transfer deflector valve.

10. An inlet system for a two cycle internal combustion engine comprising:

a cylinder and a piston which slidably translates within said cylinder and defining a combustion chamber between a closed end of said cylinder and a head of said piston;

a wall of said cylinder including at least two inlet ports therethrough extending substantially circumferentially part way around said cylinder and in fluid communication with an inlet passage;

arcuately shaped transfer deflector valve mounted for sliding arcuate movement within said inlet passage which, when closed, is in substantial alignment with at least one said inlet port, an inner arcuate surface of said transfer deflector valve substantially sealingly engaged against a portion of an outer surface of said cylinder wall adjacent at least one said inlet port;

said transfer deflector valve sized and slidably movable between a closed position wherein at least a substantial portion of at least one said inlet port is covered by said transfer deflector valve and an open position wherein substantially all of at least one said inlet port is open and uncovered by said transfer deflector valve;

means for controlledly positioning said transfer deflector valve at any point between said closed and said open position whereby said inlet ports are sequentially opened in proportion to movement of said transfer deflector valve.

11. An inlet system for a two cycle stepped piston internal combustion engine comprising:

first and second cylinders positioned in spaced side by side relation and adapted for alternate firing, said first and second cylinders each having a smaller diameter combustion section and a larger diameter pumping section;

a stepped piston for each said cylinder including a power section in substantially sealed sliding contact within said combustion section of said cylinder and a pumping section in substantially sealed sliding contact within said pumping section of said cylinder;

a wall of each said combustion section of each said cylinder including at least two inlet ports therethrough extending circumferentially part way therearound in fluid communication with an inlet passage;

an arcuately shaped transfer deflector valve mounted for sliding arcuate movement within each said inlet passage in substantial alignment with at least one corresponding said inlet port, an inner arcuate substantially continuous surface of each said transfer deflector valve substantially sealingly engaged against a portion of an outer surface of said cylinder wall adjacent said inlet port;

each said transfer deflector valve sized and slidably moveable between a closed position wherein at least a substantial portion of at least one corresponding said inlet port is covered by one said transfer deflector valve and an open position wherein substantially all of each said inlet port is open and uncovered by said transfer deflector valve;

means for controlledly positioning each said transfer deflector valve anywhere between said closed and said open position whereby said inlet port is sequentially opened in proportion to movement of said transfer deflector valve;

two transfer passages each in fluid communication between said pumping section of said cylinder and a corresponding said inlet passage of said cylinder whereby a fresh fuel charge drawn into each said pumping section during each downstroke of a corresponding said piston and is forced into said inlet passage of said cylinder during each upstroke of the corresponding said piston.

12. An inlet system for a two cycle internal combustion engine comprising:

a cylinder and a piston which slidably translates within said cylinder and defining a combustion chamber between a closed end of said cylinder and a head of said piston;

a wall of said cylinder having at least two inlet ports therethrough extending substantially circumferentially part way around said cylinder through less than about 180° and in fluid communication with an inlet passage;

an elongated arcuately shaped valve means for sliding arcuate movement within said inlet passage which, when closed, is in substantial alignment with said inlet port, an inner arcuate substantially continuous surface of said valve means being substantially sealingly engaged against a portion of an outer surface of said cylinder wall adjacent said inlet port;

means for controlledly positioning said valve means at any point between a closed position wherein at least a substantial portion of said inlet port is covered by said valve means and said open position wherein substantially all of said inlet port is open and uncovered by said valve means.

13. An inlet system for a two cycle internal combustion engine comprising:

a cylinder and a piston which slidably translates within said cylinder and defining a combustion chamber between a closed end of said cylinder an a head of said piston;

a wall of said cylinder including an elongated inlet port therethrough extending substantially circumferencially part way around said cylinder and in fluid communication with an inlet passage;

said inlet port including end wall segments which are angled in cooperation with said inlet passage to arcuately deflect each fresh charge of fuel entering said inlet passage into said combustion chamber for enhanced full mixture uniformity just prior to combustion;

an elongated arcuately shaped transfer deflector valve mounted for sliding arcuate movement within said inlet passage which, when closed, is in substantial alignment with said inlet port, an inner arcuate substantially continuous surface of said transfer deflector valve substantially sealingly engaged against a portion of an outer surface of said cylinder wall adjacent said inlet port;

said transfer deflector valve sized and slidably movable between a closed position wherein at least a substantial portion of said inlet port is covered by said transfer deflector valve and an open position wherein substantially all of said inlet port is open and uncovered by said transfer deflector valve;

means for controlledly positioning said transfer deflector valve at any point between said closed and said open position whereby said inlet port is sequentially opened in proportion to movement of said transfer deflector valve.

14. An inlet system for a two cycle stepped piston internal combustion engine comprising:

first and second cylinders positioned in spaced side by side relation and adapted for alternate firing, said first and second cylinders each having a smaller diameter combustion section and a larger diameter pumping section;

a stepped piston for each said cylinder including a power section in substantially sealed sliding contact within said combustion section of said cylinder and a pumping section in substantially sealed sliding contact within said pumping section of said cylinder;

a wall of each said combustion section of each said cylinder including an elongated inlet port therethrough extending circumferentially part way therearound in fluid communication with an inlet passage;

each said inlet port including end wall segments which are angled in cooperation with said inlet passage to arcuately deflect each fresh charge of fuel entering said inlet passage into said combustion chamber for enhanced full mixture uniformity just prior to combustion;

an elongated arcuately shaped transfer deflector valve mounted for sliding arcuate movement within each said inlet passage in substantial alignment with a corresponding said inlet port, an inner arcuate surface of each said transfer deflector valve substantially sealingly engaged against a portion of an outer surface of said cylinder wall adjacent said inlet port;

each said transfer deflector valve sized and slidably movable between a closed position wherein at least a substantial portion of each said inlet port is covered by one said transfer deflector valve and an open position wherein substantially all of each said inlet port is open and uncovered by said transfer deflector valve;

means for controlledly positioning each said transfer deflector valve anywhere between said closed and said open position whereby said inlet port is sequentially opened in proportion to movement of said transfer deflector valve;

two transfer passages each in fluid communication between said pumping section of said cylinder and a corresponding said inlet passage of said cylinder whereby a fresh fuel charge drawn into each said pumping section during each downstroke of a corresponding said piston and is forced into said inlet passage of said cylinder during each upstroke of the corresponding said piston.

15. An inlet system for a two cycle internal combustion engine comprising:

a cylinder and a piston which slidably translates within said cylinder and defining a combustion chamber between a closed end of said cylinder and a heat of said piston;

a wall of said cylinder having an elongated inlet port therethrough extending substantially circumferentially part way around said cylinder through about less that 18020 and in fluid communication with an inlet passage;

said inlet port including end wall segments which are angled in cooperation with said inlet passage to arcuately deflect each fresh charge of fuel entering said inlet passage into said combustion chamber for enhanced full mixture uniformity just prior to combustion;

an elongated arcuately shaped valve means for sliding arcuate movement within said inlet passage which, when closed, is in substantial alignment with said inlet port, an inner arcuate surface of said valve means being substantially sealingly engaged against a portion of an outer surface of said cylinder wall adjacent said inlet port;

means for controlledly positioning said valve means at any point between a closed position wherein at least a substantial portion of said inlet port is covered by said valve means and said open position wherein substantially all of said inlet port is open and uncovered by said valve means.

* * * * *

UNITED STATES PATENT AND TRADEMARK OFFICE

CERTIFICATE OF CORRECTION

PATENT NO. : 5,769,040

DATED : June 23, 1998

INVENTOR(S) : Oval F. Christner and David L. Christner

It is certified that error appears in the above-indentified patent and that said Letters Patent is hereby corrected as shown below:

Column 7, line 6, replace "which en", with -- which, when --.

Column 10, line 60, replace "18020", with --180°--.

Signed and Sealed this

Fifteenth Day of December, 1998

Bruce Lehman

*Attest:*

BRUCE LEHMAN

*Attesting Officer*

*Commissioner of Patents and Trademarks*